US007518320B2

(12) United States Patent
Chen et al.

(10) Patent No.: US 7,518,320 B2
(45) Date of Patent: Apr. 14, 2009

(54) LED CONTROL CIRCUIT CAPABLE OF AUTOMATICALLY CONTROLLING BRIGHTNESS OF LEDS ACCORDING TO AMBIENT LIGHT CONDITIONS

(75) Inventors: Xiao-Zhu Chen, Shenzhen (CN); Ming-Ke Chen, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/760,737

(22) Filed: Jun. 9, 2007

(65) Prior Publication Data

US 2008/0136335 A1 Jun. 12, 2008

(30) Foreign Application Priority Data

Dec. 8, 2006 (CN) ..... 2006 1 0201256

(51) Int. Cl.
*H05B 37/02* (2006.01)

(52) U.S. Cl. ..... 315/291; 315/287; 315/209 R; 315/302

(58) Field of Classification Search ..... 315/119, 315/123, 124, 127, 128, 209 R, 216, 246, 315/247, 287, 291, 294–302, 307, 308, 362
See application file for complete search history.

(56) References Cited

U.S. PATENT DOCUMENTS 4,051,726 A * 10/1977 Hastbacka ..... 73/290 R
5,839,816 A * 11/1998 Varga et al. ..... 362/153.1
7,274,183 B1 * 9/2007 Gu et al. ..... 323/288

* cited by examiner

*Primary Examiner*—Douglas W Owens
*Assistant Examiner*—Jianzi Chen
(74) *Attorney, Agent, or Firm*—Frank R. Niranjan

(57) ABSTRACT

An exemplary LED control circuit includes an observation circuit to detect brightness of ambient light and generating a voltage signal accordingly; a sampling circuit to receive the voltage signal and generate a control signal according to the voltage signal; a controller to generate a selection signal according to the control signal received from the sampling circuit; and a regulating circuit connected to an LED driving circuit for adjusting a current of the LED driving circuit according to the selection signal.

14 Claims, 2 Drawing Sheets

LED CONTROL CIRCUIT CAPABLE OF AUTOMATICALLY CONTROLLING BRIGHTNESS OF LEDS ACCORDING TO AMBIENT LIGHT CONDITIONS

BACKGROUND OF THE INVENTION

1. Field of the Invention

The present invention relates to LED control circuits, and particularly to an LED control circuit capable of automatically controlling brightness of LEDs according to ambient light conditions.

2. Description of Related Art

Light-emitting diode (LED) arrays have shown great potential as a light source in LCD backlighting systems. When compared to other light sources such as cold cathode fluorescent lamp (CCFL) sources, LED arrays are desirable for their low-temperature performance, ease of heat-sinking, dimming range, small size, low power consumption, relatively low cost, luminous efficacy, and directional emission.

Some LCD backlights are required to emit light of a constant brightness during use. Other LCD backlights are required to perform in multiple viewing modes, each of the modes having different brightness requirements. For example, an LCD display may be required to perform in a daylight viewing mode as well as in a night-time viewing mode, and the brightness requirements for the viewing modes are vastly different from each other. In such circumstances, it would be helpful to control the luminance of the backlight.

What is needed, therefore, is an LED control circuit which can solve above problem.

SUMMARY OF THE INVENTION

An exemplary LED control circuit includes an observation circuit to detect brightness of ambient light and generating a voltage signal accordingly; a sampling circuit to receive the voltage signal and generate a control signal according to the voltage signal; a controller to generate a selection signal according to the control signal received from the sampling circuit; and a regulating circuit connected to an LED driving circuit for adjusting a current of the LED driving circuit according to the selection signal.

Other advantages and novel features will become more apparent from the following detailed description when taken in conjunction with the accompanying drawings, in which:

DETAILED DESCRIPTION OF THE INVENTION

Figure 1:
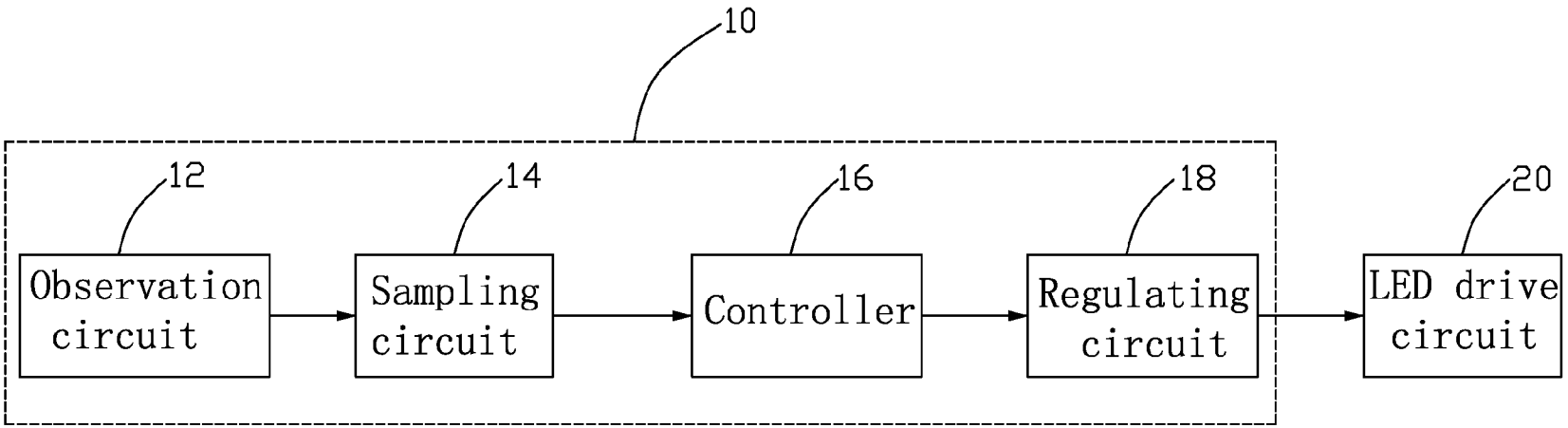
FIG. 1 is a block diagram of one embodiment of an LED control circuit in accordance with the present invention.

Referring to FIG. 1, an LED control circuit 10 in accordance with an embodiment of the present invention includes: an observation circuit 12 to detect the brightness of ambient light in a working environment for generating a voltage signal according to the brightness; a sampling circuit 14 to generate a control signal according to the voltage signal; a controller 16 to generate a selection signal according to the control signal; and a regulating circuit 18 connected to an LED driving circuit 20 for adjusting a working current of the LED driving circuit according to the selection signal.

Figure 2:
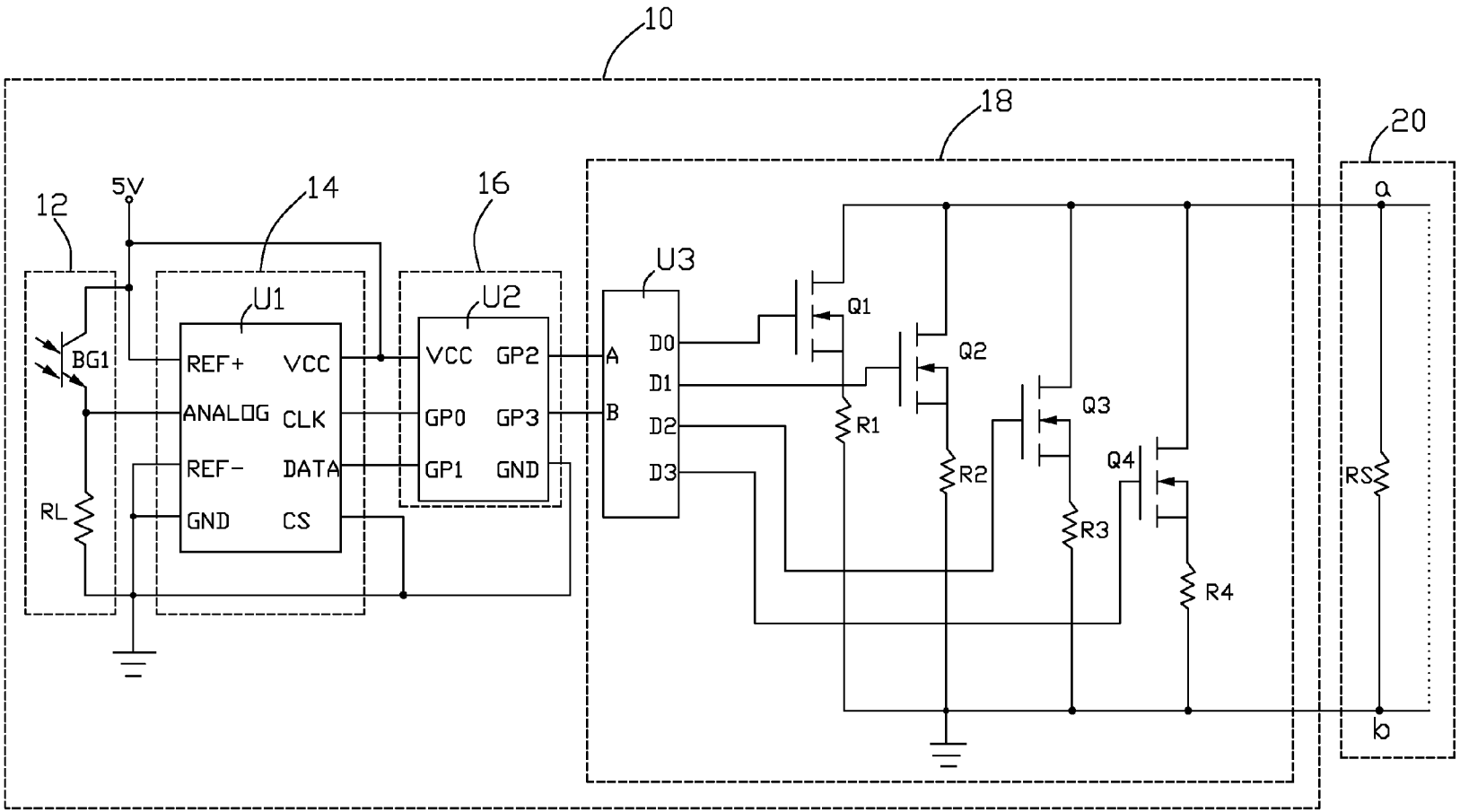
FIG. 2 is a circuit diagram of FIG. 1.

Referring to FIG. 2, the observation circuit 12 includes a photistor BG1 and a resistor RL connected in series between an electrical source 5V and ground. The photistor BG1 turns on when detecting ambient light. The voltage signal is numerically equal to a voltage drop across the resistor RL.

The resistor RL can be a volt box as well for regulating the voltage drop across the resistor RL.

The sampling circuit 14 includes an analog to digital (A/D) converter U1 with a power pin VCC, a ground pin GND, an input pin ANALOG, an output pin DATA, a selecting pin CS, a clock pin CLK, a positive reference voltage input pin REF+, and a negative reference voltage input pin REF−. The power pin VCC is connected to the electrical source 5V. The ground pin is grounded. The input pin ANALOG is connected to a node between the photistor BG1 and the resistor RL for receiving the voltage signal. The selecting pin CS is grounded. The positive reference voltage input pin REF+ and the negative reference voltage input pin REF− are respectively connected to the electrical source 5V and ground. The clock pin CLK is connected to the controller 16 to receive a clock frequency. The sampling circuit 14 samples the voltage signal at each cycle of the clock frequency.

The controller 16 includes a chipset U2 with a power pin VCC, a ground pin GND being grounded, and four signal pins GP0~GP3. The power pin VCC of the chipset U2 is connected to the electrical source 5V. The signal pin GP0 is connected to the clock pin CLK of the A/D converter U1 to provide a clock frequency. The signal pin GP1 is connected to the output pin DATA of the A/D converter U1 for receiving the control signal.

In this exemplary embodiment, the regulating circuit 18 includes a selection switch U3 with two input terminals A~B and four output terminals D0~D3, four electric switches Q1~Q4, and four resistors R1~R4. Each of the four electric switches Q1~Q4 has a gate, a source, and a drain. The four electric switches Q1~Q4 are NPN Metal Oxide Semiconductor Field-Effect Transistors (N-MOSFETs). It should be noted that in other embodiments, other types of switches may be used for the selection switch U3 and other quantities of the electric switch elements can be utilized.

The input terminals A~B of the selection switch U3 are connected to the corresponding signal pins GP2~GP3 of the chipset U2 respectively for receiving the selection signal. The gates of the electric switches Q1~Q4 are connected to the corresponding output terminals D0~D3 respectively. The drains of the electric switches Q1~Q4 are connected to one end of a load resistor RS of the LED driving circuit 20. The sources of the electric switches Q1~Q4 are connected to ground via the resistors R1~R4 respectively. The other end of the load resistor RS is grounded. The working current of the LED driving circuit 20 which determines the brightness of the LED can be regulated by adjusting the resistance of the effective load of the LED driving circuit 20 between nodes a, b at opposite ends of the load resistor RS. Therefore, when any one of the electric switches Q1~Q4 is open, the working current of the LED driving circuit will be augmented because the effective load of the LED driving circuit 20 is decreased as a result of the load resistor RS being connected in parallel with the any one of the resistors R1~R4.

The A/D converter U1 of the sampling circuit 14 receives the voltage signal, which is adjusted by the photistor BG1 according to brightness of ambient light, and sends a corresponding control signal to the controller 16. The controller 16 generates a corresponding selection signal. The selection signal includes one of four binary numbers 00~11 according to the control signal. The selection switch U3 can respectively turn on the electric switches Q1~Q4 according to the binary numbers 00~11 of the selection signal for selectively connecting in parallel one of the four resistor R1~R4 to the load resistor RS of the LED driving circuit 20. Therefore, brightness of the ambient light controls the voltage drop across the resistor RL via the photistor BG1, and then the LED control circuit 10 will adjust the brightness of the LED accordingly.

Additionally, the configuration of the observation circuit 12 as disclosed above can be changed and/or adjusted according to some other detectable or measurable condition such as time of day, or season of the year, and so on. The regulating circuit 18 can also be adjusted according to the resistance of the resistors, the amount of the electric switches, and the type of the selection switch U3 utilized.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An LED control circuit comprising:

an observation circuit to detect a condition of a working environment for generating a voltage signal accordingly;

a sampling circuit to receive the voltage signal and generate a digital control signal according to the voltage signal;

a controller comprising two outputs to selectively output four binary numbers according to the digital control signal received from the sampling circuit;

an LED driving circuit comprising a load resistor; and a regulating circuit comprising four current dividing circuits and a selection switch, wherein each current dividing circuit comprises a resistor and an electric switch element being connected in series, the selection switch comprises two inputs connected to the two outputs of the controller for receiving the binary numbers, and four outputs to respectively output four logical signals to control one or more of the electric switch elements on or of accordingly to thereby adjust the resistance of an effective load of the LED driving circuit between two opposite terminals of the load resistor such that a working current of the LED driving circuit is regulated according to the condition of the working environment.

2. The LED control circuit as claimed in claim 1, wherein the condition is ambient light of the working environment.

3. The LED control circuit as claimed in claim 2, wherein the observation circuit includes a photistor and a resistor connected in series between an electrical source and ground, for generating the voltage signal on the resistor when the photistor is turned on to sense the brightness of the ambient light.

4. The LED control circuit as claimed in claim 3, wherein the resistor of the observation circuit is a volt box.

5. The LED control circuit as claimed in claim 3, wherein the sampling circuit includes an A/D converter with a power pin being connected to the electrical source, a ground pin being grounded, an input pin being connected to a node between the photistor and the resistor of the observation circuit, an output pin being connected to the controller, a selecting pin being grounded, a clock pin being connected to the controller, a positive reference voltage input pin being connected to the electrical source, and a negative reference voltage input pin being grounded.

6. The LED control circuit as claimed in claim 5, wherein the controller includes a chipset with a power pin being connected to the electrical source, a ground pin being grounded, a signal pin being connected to the output pin of the A/D converter for receiving the digital control signal, a clock pin being connected to the clock pin of the A/D converter to provide a clock frequency.

7. The LED control circuit as claimed in claim 6, wherein the electric switch element includes:

a gate, a source and a drain, wherein the drain of the electric switch element is electrically coupled to an end of the load resistor of the LED driving circuit, and the gate of the electric switch element is electrically coupled to a corresponding output terminal of the selection switch.

8. The LED control circuit as claimed in claim 1, wherein the electric switch element is an NPN Metal Oxide Semiconductor Field-Effect Transistor (N-MOSFET).

9. An LED control circuit comprising:

an observation circuit configured for detecting ambient brightness of an LED display to generate a voltage signal accordingly;

a sampling circuit configured to receive the voltage signal and generate a digital control signal according to the voltage signal;

a controller configured to generate a selection signal according to the digital control signal received from the sampling circuit; and a regulating circuit configured to be connected to an LED driving circuit of the LED display which comprises a load resistor, the regulating circuit comprising a plurality of resistors connected between opposite two terminals of the load resistor in parallel, each of the resistors connecting with an electronic switch in series, the regulating circuit further comprising a selection switch connected to the controller for receiving the selection signal to output a plurality of logical signals to control one or more of the electronic switches on or off accordingly to thereby adjust the resistance of an effective load of the LED driving circuit between the opposite two terminals of the load resistor such that a working current of the LED driving circuit which determines the brightness of the LED display is regulated according to the ambient brightness of the LED display.

10. The LED control circuit as claimed in claim 9, wherein the observation circuit comprises a photistor and a resistor connected in series between an electrical source and ground, the voltage signal being generated from an node between the photistor and the resistor when the photistor is turned on to sense the ambient brightness.

11. The LED control circuit as claimed in claim 9, wherein the condition is ambient light of the working environment.

12. The LED control circuit as claimed in claim 11, wherein the resistor of the observation circuit is a volt box.

13. The LED control circuit as claimed in claim 11, wherein the sampling circuit includes an A/D converter with a power pin being connected to the electrical source, a ground pin being grounded, an input pin being connected to a node between the photistor and the resistor of the observation circuit, an output pin being connected to the controller, a selecting pin being grounded, a clock pin being connected to the controller, a positive reference voltage input pin being connected to the electrical source, and a negative reference voltage input pin being grounded.

14. The LED control circuit as claimed in claim 13, wherein the controller includes a chipset with a power pin being connected to the electrical source, a ground pin being grounded, a signal pin being connected to the output pin of the A/D convener for receiving the digital signal, a clock pin being connected to the clock pin of the A/D converter to provide a clock frequency.

* * * * *